US005971784A

United States Patent [19]

Fabian et al.

[11] Patent Number: 5,971,784

[45] **Date of Patent: *Oct. 26, 1999**

[54] ELECTRICAL CONNECTOR HAVING DUAL DIRECTIONAL MATING

[75] Inventors: David James Fabian, Mt. Joy; Richard Scott Kline, Harrisburg; Timothy Lee Kocher, Camp Hill, all of Pa.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/872,522

[22] Filed: Jun. 11, 1997

[51] Int. Cl.[6] ..... H01R 27/00

[52] U.S. Cl. ..... 439/224; 439/218

[58] Field of Search ..... 439/221, 224, 439/850, 842, 872, 871, 856, 781, 801, 709, 884

[56] References Cited

U.S. PATENT DOCUMENTS

| | | | |
|---|---|---|---|
| 2,024,814 | 12/1935 | Bell | 173/269 |
| 3,065,448 | 11/1962 | Hopkins et al. | 439/872 |
| 3,088,088 | 4/1963 | Reider, Jr. | 339/32 |
| 3,097,906 | 7/1963 | Shannon | 339/253 |
| 3,208,027 | 9/1965 | Johnson | 339/17 |
| 3,986,762 | 10/1976 | Reeder . | |
| 4,655,522 | 4/1987 | Beck, Jr. et al. | 439/224 |
| 4,795,379 | 1/1989 | Sasaki et al. | 439/856 |
| 4,820,179 | 4/1989 | Saijo | 439/224 |
| 5,207,603 | 5/1993 | Peloza | 439/884 |
| 5,252,097 | 10/1993 | Lindeberg et al. | 439/856 |
| 5,595,505 | 1/1997 | Duke et al. | 439/709 |
| 5,741,161 | 4/1998 | Cahaly et al. | 439/709 |
| 5,766,033 | 6/1998 | Davis | 439/405 |

*Primary Examiner*—Gary Paumen
*Attorney, Agent, or Firm*—Katherine A. Nelson; Mary K. Vanatten

[57] ABSTRACT

A connector (24) is disclosed for electrically interconnecting a component (14) to circuitry within a cabinet (10), where the component is arranged to slide in and out of a bay (12) in the cabinet (10). The connector (24) is attached to the component (14) and includes an insulated housing (40) having a plurality of electrical contacts (60) arranged therein. The contacts (60) are adapted for mating along a first mating axis (23) of the connector with respective ones of other electrical contacts (100) in a mating connector (26) attached to the cabinet (10). The contacts (60) of the connector (24) are further adapted for mating along a second mating axis (74), that forms a right angle to the first mating axis (23), with respective ones of individual contacts (158) attached to individual wires (156) that are secured to the cabinet (10).

16 Claims, 7 Drawing Sheets

ELECTRICAL CONNECTOR HAVING DUAL DIRECTIONAL MATING

The present invention relates to electrical connectors for electrically interconnecting removable components such as circuit breakers with other equipment in an equipment cabinet and more particularly to such a connector having contacts that can mate along one direction with contacts of a mating connector and along another direction with individual terminals.

BACKGROUND OF THE INVENTION

In the electrical power distribution industry, as well as other industries, large equipment cabinets are provided containing electrical components that are electrically interconnected to other equipment in the cabinet. Some of these components, such as large circuit breakers, must be able to be temporarily disconnected and removed or simply disconnected and left in place. Such components are usually arranged on rails or slides within the equipment cabinet which permit the component to slide into the equipment cabinet along a mating axis for electrical mating and out of the equipment cabinet for removal. There is usually a primary connector and a secondary connector that must be mated. In the case of a circuit breaker, for example, the primary connector interconnects the power circuits while the secondary connector interconnects various test and control circuits. The secondary connector attached to and carried by the circuit breaker usually includes guide members, such as posts having tapered ends, that engage corresponding guide features associated with the mating connector, such as holes. In certain applications a conventional terminal strip is substituted for the secondary connector which is then interconnected to the cabinet circuitry by means of separate conductors having terminals attached to their ends. Therefore, the secondary circuits of the circuit breaker must be capable of being mated to either a mating connector or individual terminated conductors. This, of course, requires two different circuit breakers, one with a secondary connector and one with a terminal strip. Additionally, when mating with the mating connector, movement of the secondary connector along the mating axis corresponds to the movement of the circuit breaker, which is front to back as the circuit breaker is moved along its rails into the cabinet. This direction, however, is unsuitable for mating with the individual terminals, which must by mated manually with the circuit breaker partially in the cabinet. Ideally, the terminal strip should be accessible from the top or sides of the circuit breaker where operator visibility of the contacts is greatest.

What is needed is a secondary connector having electrical contacts that are able to mate both with the contacts of the mating connector as the circuit breaker is inserted into the cabinet and with the individual terminated conductors when the circuit breaker is partially inserted in the cabinet. Further, the secondary connector should be arranged so that mating of the individual terminated conductors is accomplished from the top or sides of the circuit breaker.

SUMMARY OF THE INVENTION

A connector is disclosed including a first housing having a plurality of first electrical contacts arranged therein. The first electrical contacts are adapted for mating along a first mating axis of the connector with respective ones of a plurality of second electrical contacts in a second housing of a mating connector. The first electrical contacts are further adapted for mating along a second mating axis, that is angled with respect to the first mating axis, with respective ones of a plurality of individual contacts. The first housing includes a first surface and a portion of each of some of the first contacts extends outwardly from the first surface so that its respective longitudinal axis is substantially perpendicular to both the first surface and the first mating axis. The connector may include a second surface and a portion of each of others of the first contacts extends outwardly from the second surface so that its respective longitudinal axis is substantially perpendicular to both the first surface and the first mating axis. The second surface is offset with respect to the first surface.

DESCRIPTION OF THE PREFERRED EMBODIMENT

Figure 1:
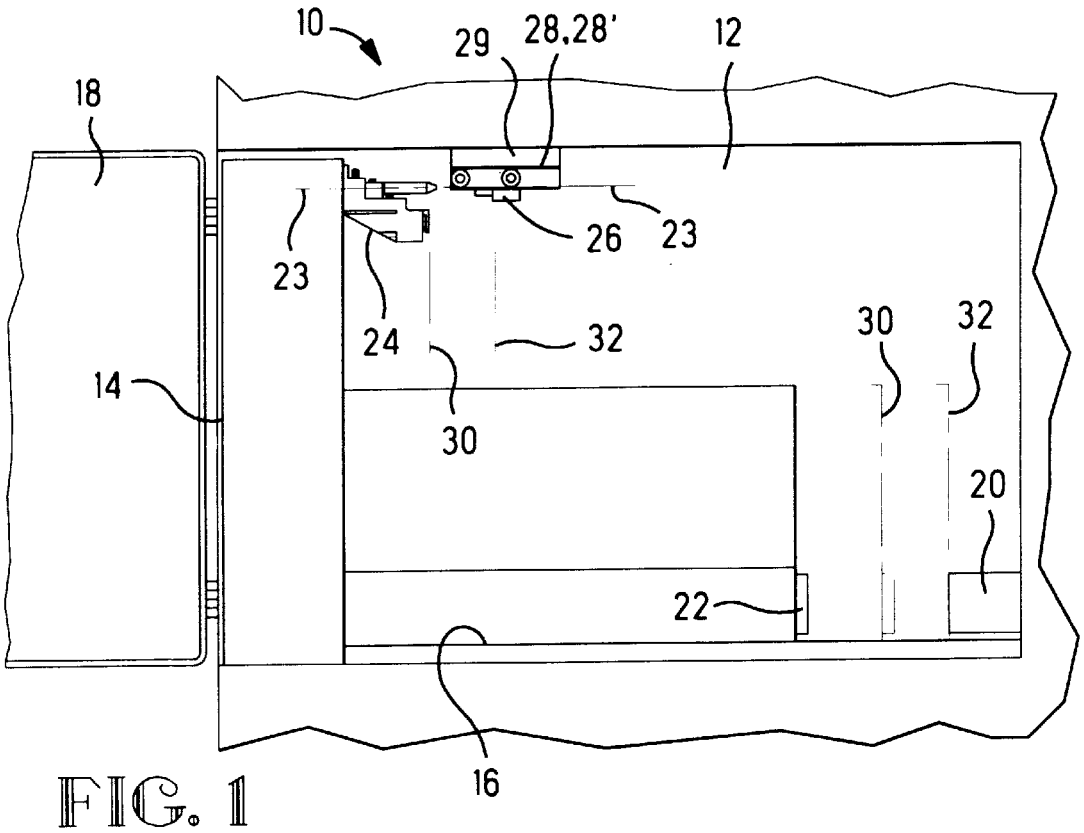
FIG. 1 is a schematic representation of a cross-sectional view showing a circuit breaker within an equipment cabinet having a connector incorporating the teachings of the present invention.

There is shown in FIG. 1 an equipment cabinet 10 of the type used for holding power switchgear for low voltage power distribution. The cabinet 10 includes a bay 12 for holding a component 14 such as a circuit breaker which is arranged to slide along rails 16 into and out of the bay. The bay 12 includes a door 18 that is hinged to the cabinet 10 and completely covers the open end of the bay when closed. The door 18 may be opened to gain access to the circuit breaker within the bay for maintenance, for placing the circuit breaker in operation, or for removing it from operation. While power switchgear is used to describe the present invention, it will be understood that this is by way of example only and that the teachings of the present invention may be advantageously utilized with other types of equipment as well.

As best seen in FIG. 1 the circuit breaker 14 is shown fully within the bay 12 with the door 18 open. A primary electrical connector 20 is attached to structure of the cabinet 10 within the bay 12, and carries the power that is to be protected by the circuit breaker 14. A mating primary connector 22 is attached to and carried by the circuit breaker 14 for moving along a mating axis 23 to mate with the connector 20 when the circuit breaker 14 is inserted into the bay 12 into a position known as the connect position, as will be explained in further detail below. A secondary electrical connector 24 is attached to and carried by the circuit breaker 14. A mating secondary connector 26 is coupled to the cabinet 10 within the bay 12 by means of right and left coupling assemblies 28 and 28', respectively, which are secured to brackets 29 by screws or other suitable means. The mating secondary connector 26 is arranged to mate with the connector 24 when the circuit breaker is in a test position, shown in phantom lines 30 in FIG. 1, the primary connectors 20 and 22 are not mated. When the circuit breaker is in a connect position, shown in phantom lines 32 in FIG. 1, the primary connectors are mated. As the circuit breaker 14 moves from the test position to the connect position, the secondary connector 24 remains mated with the mating secondary connector 26 as the couplings 28 and 28' permit movement of the connector 26 from left to right, as viewed in FIG. 1.

Figure 5:
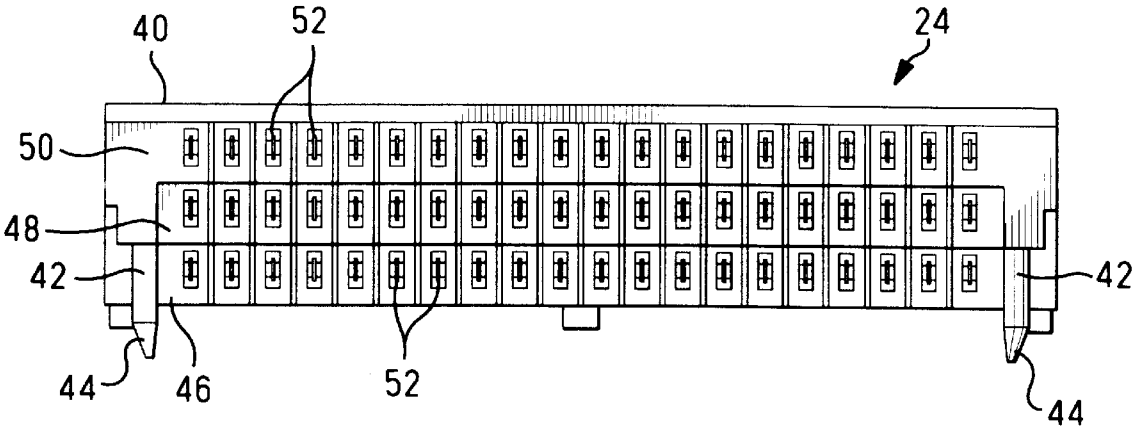
FIGS. 3, 4, and 5 are front, end, and top views, respectively, of the plug portion of the connector shown in FIG. 1.
Figure 3:
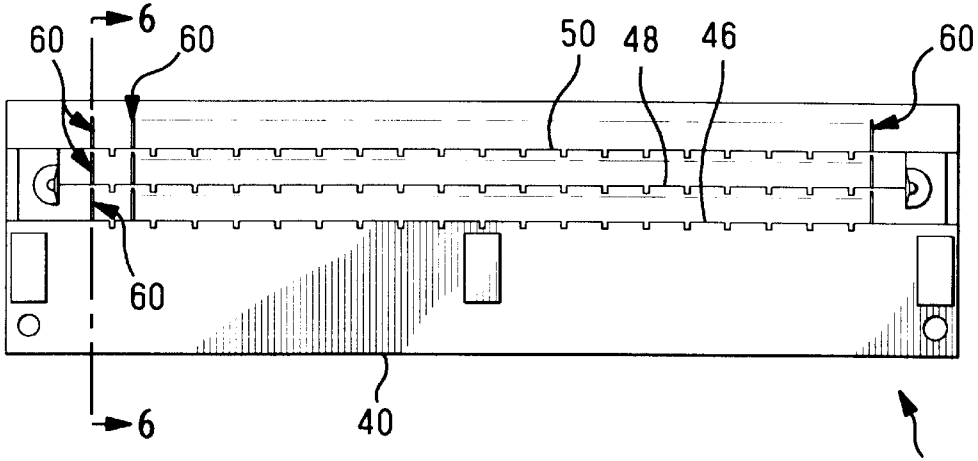
Figure 6:
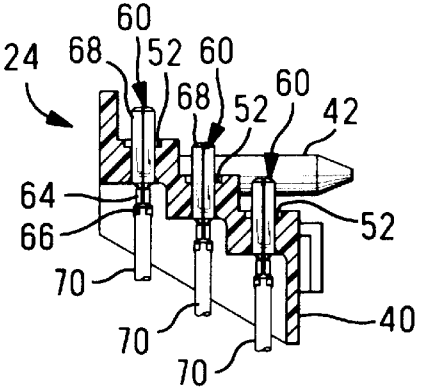
FIG. 6 is a cross-sectional view taken along the lines 6—6 in FIG. 3.
Figure 4:
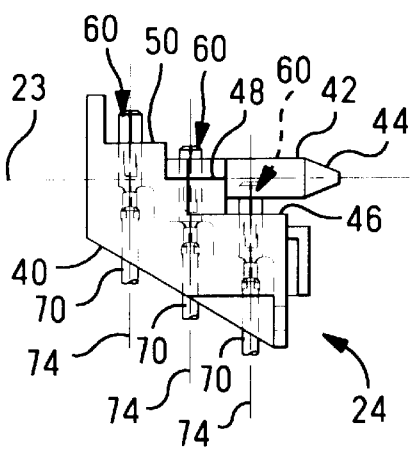
Figure 9:
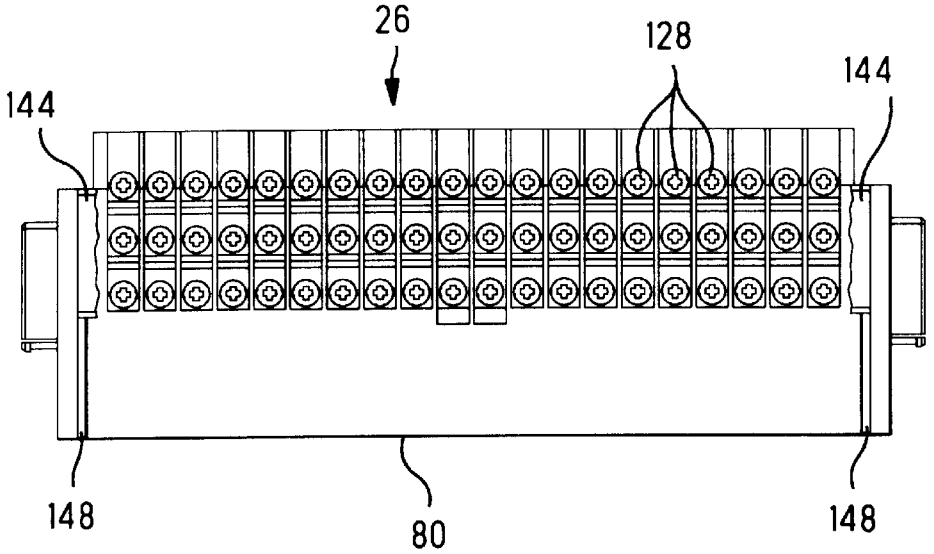
FIGS. 7, 8, and 9 are front, end, and top views, respectively, of the receptacle portion of the connector shown in FIG. 1.
Figure 11:
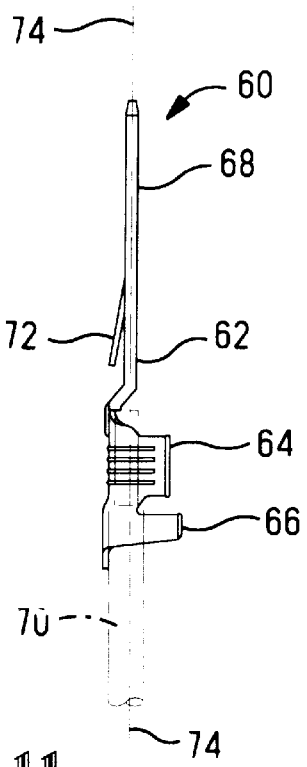
FIGS. 11 and 12 are side and plan views, respectively, of the plug contacts.
Figure 12:
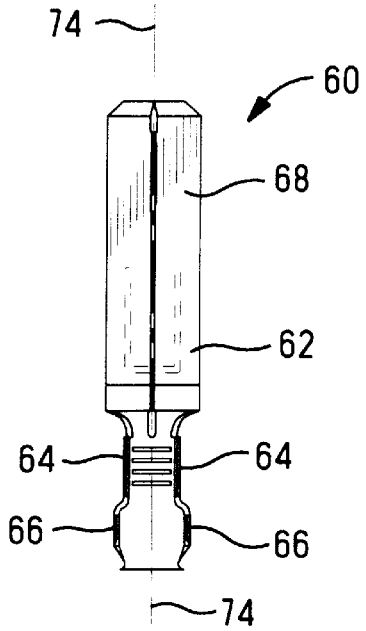

As shown in FIGS. 3, 4, 5, and 6, the secondary connector 24 includes an insulating housing 40 having a pair of spaced guide members 42 including tapered ends 44 for mating with respective openings in the mating secondary connector 26 when the connector 24 is moved along the mating axis 23 into engagement with the connector 26. The housing 40 includes first, second, and third mutually offset surfaces 46, 48, and 50, respectively, that extend the length of the housing, as best seen in FIGS. 3 and 4. A series of openings 52 are formed through the housing so that a first row of openings intersects the first surface 46, a second row of openings intersects the second surface 48, and a third row of openings intersects the third surface 50, as shown in FIGS. 5 and 6. Plug type electrical contacts 60 are arranged in the openings 52, one contact in each opening thereby forming three separate rows of electrical contacts. As best seen in FIGS. 11 and 12, the plug type electrical contacts 60 include a shank 62, crimping tabs 64 and 66 extending from the shank, and a blade contact 68 extending from an end of the shank opposite the crimping tabs. An insulated conductor 70 is shown in phantom lines, in FIG. 11, in place so that the crimping tabs 64 and 66 are ready to be crimped on the conductor and the insulation in the usual manner. A resilient locking lance 72 extends outwardly from the shank, as best seen in FIG. 11, for engaging a cutout in the wall of the opening 52 and retaining the contact within the opening in the usual manner. Each of the contacts 60 has a longitudinal axis 74 extending through the shank 62 and blade contact 68. The contacts are arranged in their respective openings 52 so that their longitudinal axes 74 are perpendicular to both the mating axis 23 and their respective first, second, and third surfaces 46, 48, and 50, as best seen in FIG. 4.

Figure 8:
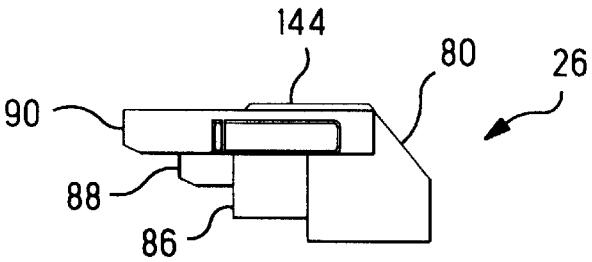
Figure 7:
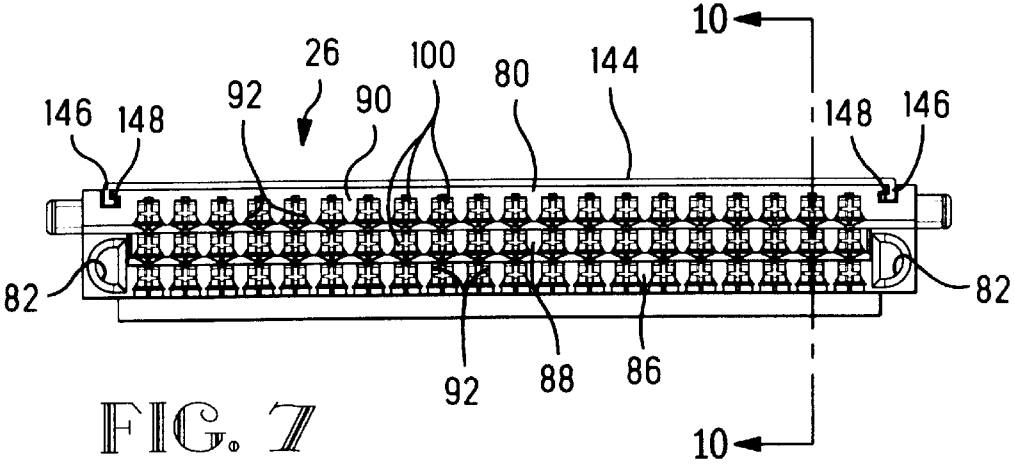
Figure 10:
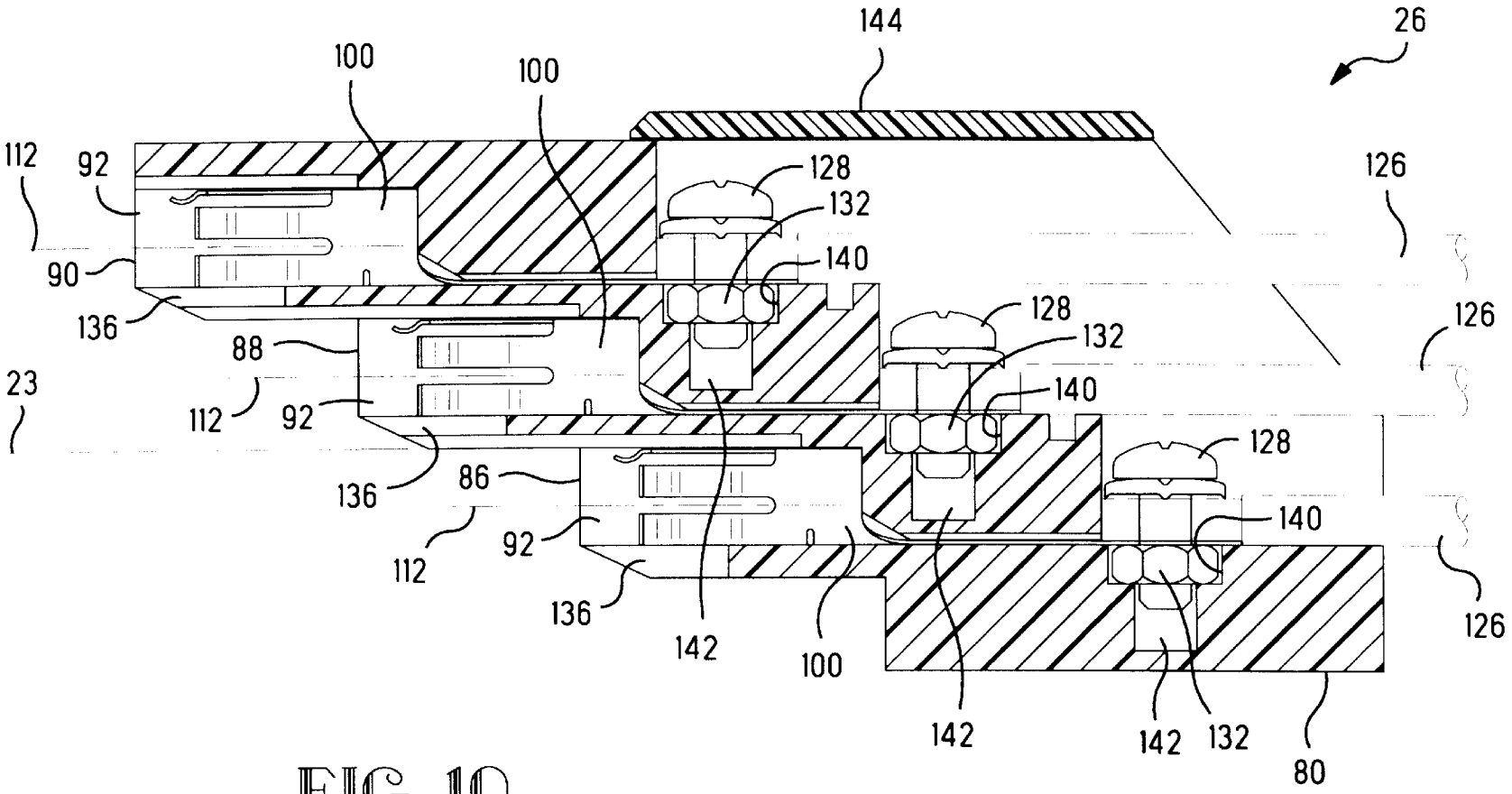
FIG. 10 is a cross-sectional view taken along the lines 10—10 in FIG. 7.
Figure 14:
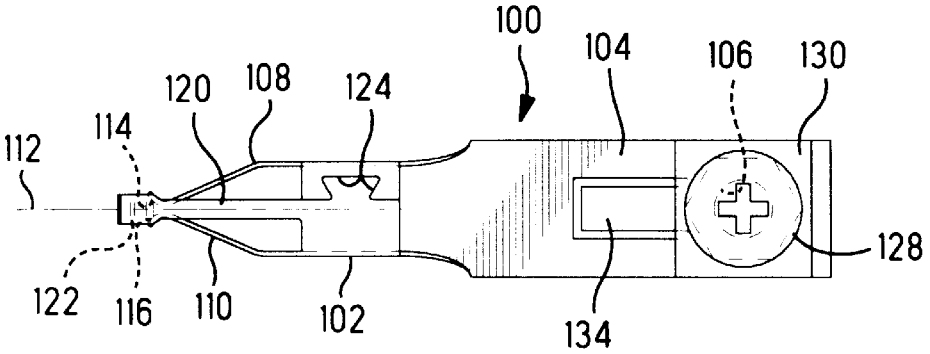
FIGS. 13 and 14 are side and plan views, respectively, of the receptacle contacts.
Figure 13:
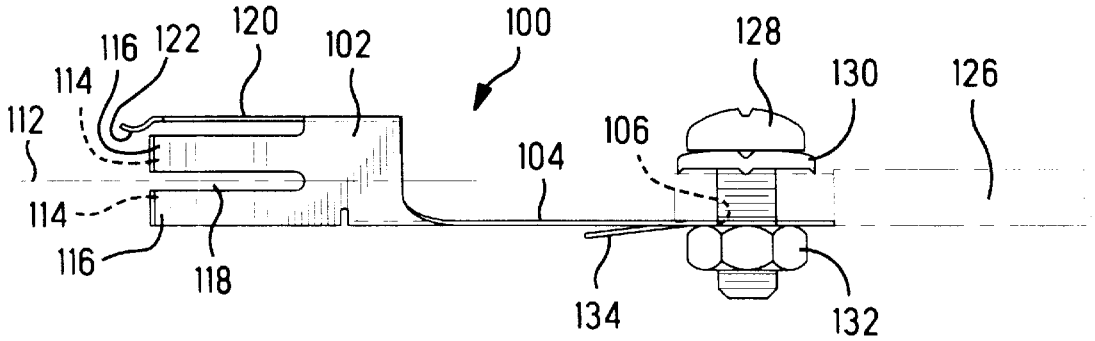

The mating secondary connector 26, as best seen in FIGS. 7, 8, 9, and 10, includes an insulating housing 80 having a pair of spaced guide openings 82 for mating with respective guide members 42 extending from the secondary connector 24 when the connector is moved along the mating axis 23 into engagement with the connector 26. The housing 80 includes first, second, and third mutually offset surfaces 86, 88, and 90, respectively, that extend the length of the housing, as best seen in FIGS. 7 and 8. A series of openings 92 are formed through the housing so that a first row of openings intersects the first surface 86, a second row of openings intersects the second surface 88, and a third row of openings intersects the third surface 90, as shown in FIGS. 7 and 10. Receptacle type electrical contacts 100 are arranged in the openings 92, one contact in each opening. As best seen in FIGS. 13 and 14, the receptacle type electrical contacts 100 include a shank 102, a tail 104 extending from the shank having a hole 106 formed therein, and a pair of resilient beam members 108 and 110 extending from an end of the shank opposite the tail on opposite sides of a longitudinal axis 112. The two beam members 108 and 110 terminate in opposing contacts 114 and 116, each of which is split into dual contacts by a narrow slot 118 resulting in four separate contact points that engage the blade contact 68. A sacrificial member 120 extends outwardly from the shank 102 vertically above and slightly past the opposing contacts 114 and 116, as best seen in FIG. 13. The sacrificial member 120 is resilient and terminates in a downwardly facing contact 122 that is arranged to electrically engage an edge of the blade contact 68 prior to engagement by the opposing contacts 114 and 116, and to disengage the blade contact after disengagement by the opposing contacts. Any arcing or other electrical discharge that occurs during mating and unmating of the connector will be absorbed and dissipated by the sacrificial member 120, thereby extending the life of the opposed contacts 114 and 116. The receptacle contact 100 is formed from a strip of flat sheet material, the walls of the shank 102 being folded upwardly and over the top to form a box-like structure that is interlocked and joined by means of a dovetail 124 or similar joint, as best seen in FIG. 14. An insulated conductor 126 is shown in phantom lines, in FIG. 13, and is secured in place by means of a screw 128 that extends through a square washer 130, through the hole 106, and into threaded engagement with a nut 132. A resilient locking lance 134 extends outwardly from the tail 104 for engaging a cutout in the bottom of the opening 92 and retaining the contact within the opening in the usual manner. The contacts are arranged in their respective openings 92 so that their longitudinal axes 112 are perpendicular to their respective first, second, and third surfaces 46, 48, and 50, and are parallel to the mating axis 23, as best seen in FIG. 10. Each opening 92 includes a slot 136 through its floor, as best seen in FIG. 10, for loosely receiving a respective blade contact 68 when the secondary connector 24 is mated with the mating connector 26. The housing 80 includes a hexagonal depression 140 and clearance hole 142 in alignment with the hole 106 of each receptacle contact 100 for receiving the nut 132 and the end of the screw 128, respectively. A sliding cover 144 is positioned on the housing 80 directly over the screws 129 to provide protection against inadvertent shorts or other unintended contact. The cover has two turned down edges 146 that slidingly engaged respective slots 148 formed in the upper surface of the housing 80. This permits the cover 144 to be slid forward to expose the screws 128 for attachment of the conductors 126.

Figure 15:
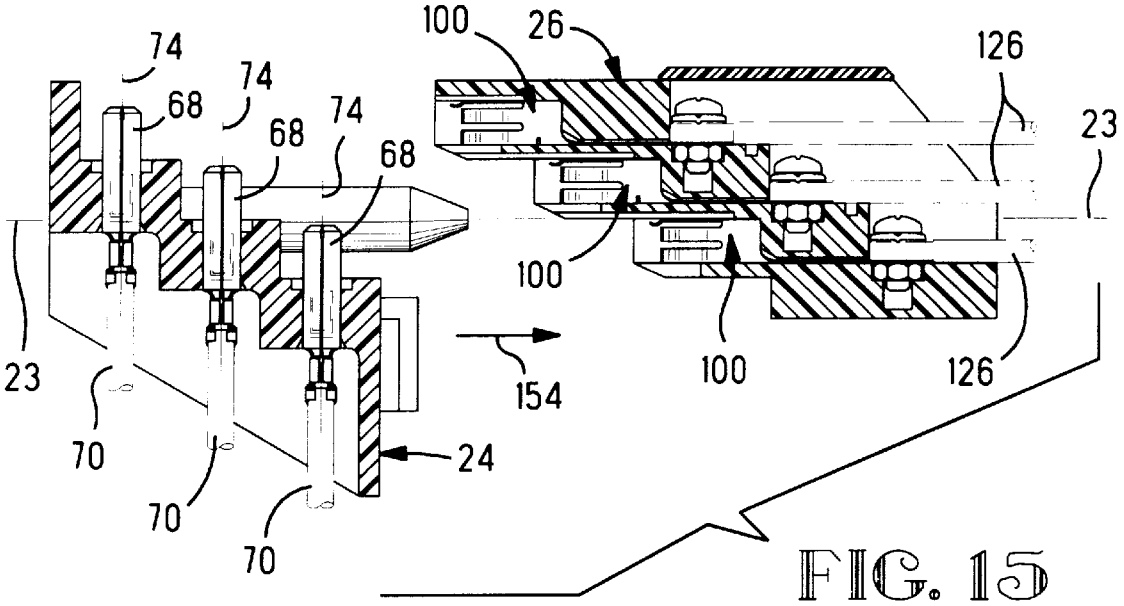
FIGS. 15, 16, and 17 are cross-sectional views of the connector shown in various operating positions.
Figure 16:
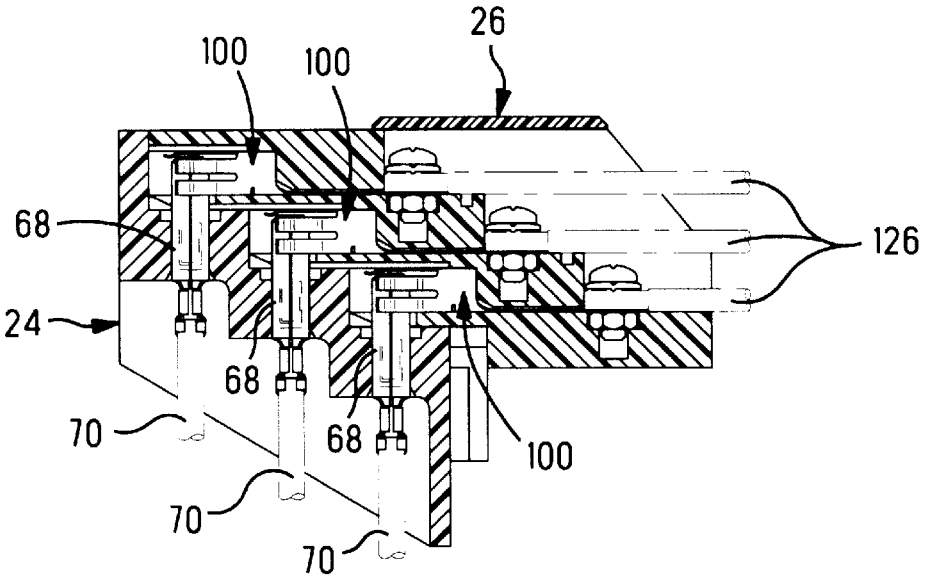

FIGS. 15 and 16 show the secondary connectors 24 and 26 in cross section, as they appear in FIGS. 6 and 10, respectively. In FIG. 15 the secondary connectors are shown in their unmated position with the circuit breaker 14 in the disconnect position as shown in FIG. 1. As the circuit breaker 14 is moved toward the test position, the connector 24 moves along the mating axis 23 in the direction of the arrow 154 shown in FIG. 15. As movement continues the blade contacts 68 first electrically engage their respective contacts 122 of the sacrificial member 120 and then immediately thereafter engage the opposing contacts 114 and 116, causing the beams 108 and 110 to elastically deflect outwardly a slight amount so that all four contact points engage the blade contact 68. Movement continues until the blade contacts 68 are fully mated with their respective receptacle contacts 100 as shown in FIG. 16. At this point the circuit breaker 14 is in its test position as indicated by the phantom lines 30 in FIG. 1.

Figure 2:
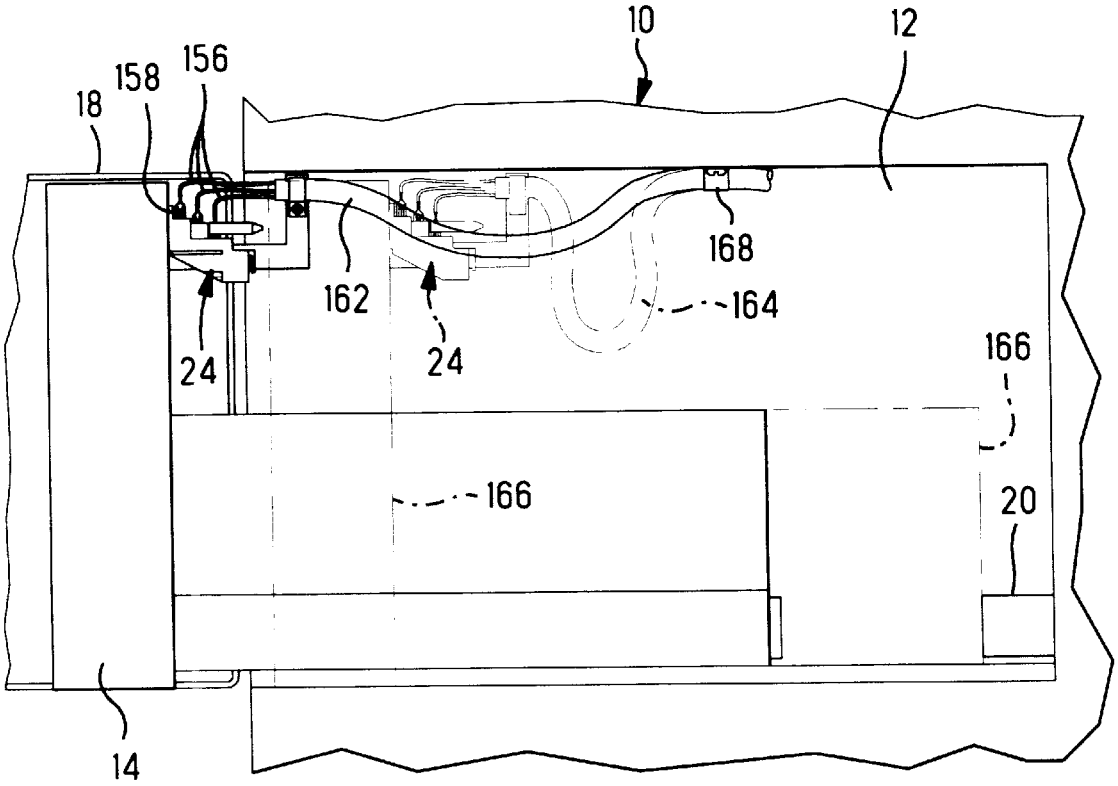
FIG. 2 is a view similar to that of FIG. 1 showing the connector mated to individual terminals.
Figure 17:
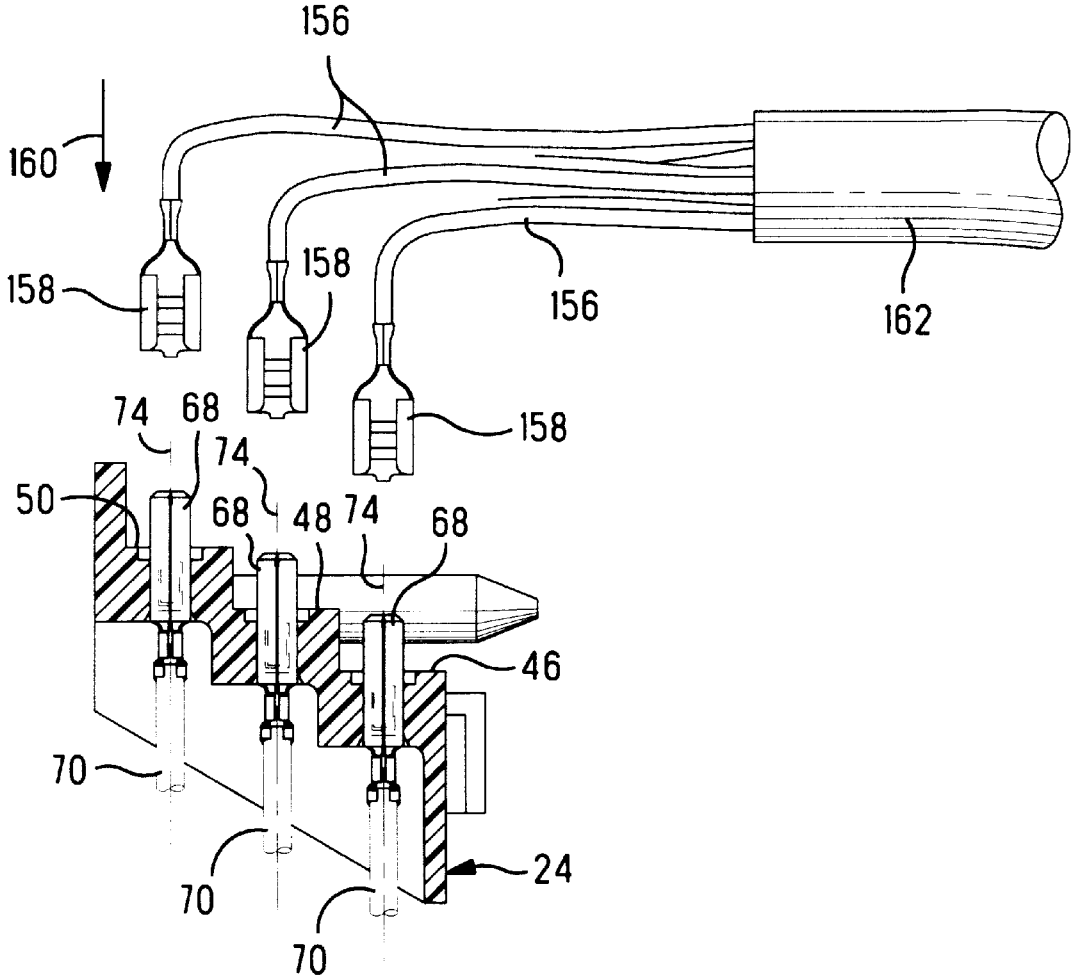

Alternatively, as shown in FIGS. 2 and 17, the connector 24 may be electrically mated with a series of discrete wires 156 without a mating connector 26. This is accomplished by means of receptacle terminals 158, such as the 0.250 series receptacle terminal sold under the trade name FASTON by AMP Incorporated of Harrisburg, Pa. 17105-3608. The terminals 158 are attached to the ends of the wires 156 in the usual manner, such as by crimping. Each of the terminals is then individually moved in the direction of the arrow 160, as shown in FIG. 17, along the longitudinal axis 74 of a respective blade contact 68 until fully mated therewith as shown in FIG. 2. The wires 156 and attached terminals 158 may be grouped in one or more cables 162 secured to the cabinet 10 by means of any suitable clamp 168 and arranged with sufficient slack, indicated by the phantom lines 164 in FIG. 2, to accommodate the movement of the circuit breaker 14 from the partially inserted position shown in solid lines in FIG. 2 to the fully inserted position shown in phantom lines 166.

It will be appreciated by those skilled in the art that when attaching the wires 156 and terminals 158 to the blade contacts 68 of the connector 24, the circuit breaker 14 must necessarily be partially inserted into the bay 12. This is because the length of the cable 162 is frequently limited and will allow only a small amount of clearance between the connector 24 and the outside front surface of the cabinet 10. If a conventional connector with rear facing pin or blade contacts were used instead of the connector 24, it would be very difficult to attach the terminals 158 because of the difficulty of clearly seeing the rear facing contacts. Use of the connector 24, on the other hand, permits easy access to and good visibility of the blade contacts 58, as seen in FIGS. 2 and 17, so that the terminals 158 can be quickly and easily attached to their proper blade contacts 68. While, in the present example, the connector 24 is oriented so that the blade contacts 68 are accessible from the top of the circuit breaker, it will be understood that the teachings of the present invention include other orientations that render the blade contacts accessible from the sides or bottom of the circuit breaker.

An important advantage of the present invention is that a single connector is capable of alternatively mating with both the contacts of a mating connector and individual terminals. Additionally, when mating with the individual terminals, the mating is easily accomplished with the circuit breaker partially within the cabinet. Increased operator visibility is provided so that interconnection errors are reduced.

We claim:

1. A connector including a first housing having a first surface and a plurality of first electrical contacts arranged in at least two rows, one of the at least two rows being offset laterally and vertically from the other of the at least two rows, each first electrical contact having a portion adapted for mating (a) along a first mating axis of said connector with a respective one of a plurality of second electrical contacts in a second housing of a mating connector, and (b) along a second mating axis of said connector, that is angled with respect to said first mating axis, with a respective one of a plurality of individual terminals, wherein each said portion of said contacts in said first row of contacts extend outwardly from said first surface.

2. The connector according to claim 1 wherein said second mating axis is angled with respect to said first mating axis at an angle of about 90 degrees.

3. The connector according to claim 1 wherein each said portion of said contacts in said first row of contacts has a longitudinal axis that is substantially perpendicular to both said first surface and to said first mating axis.

4. The connector according to claim 3 wherein said first surface is substantially planar.

5. The connector according to claim 3 wherein said second mating axis is parallel to said longitudinal axes of said first contacts.

6. The connector according to claim 3 including a second surface, wherein others of said plurality of first contacts are arranged in a second row of contacts each of which has a portion extending outwardly from said second surface wherein each said portion of said contacts in said second row of contacts has a longitudinal axis that is substantially perpendicular to both said second surface and to said first mating axis, said second surface being offset with respect to said first surface.

7. The connector according to claim 6 wherein said first and second surfaces define planes that are mutually spaced apart.

8. The connector according to claim 7 wherein each of said first contacts comprises a shank secured within a portion of said first housing, a tail extending from said shank and arranged to be attached to a conductor, and a blade-shaped contact extending from a side of said shank opposite said tail, said blade-shaped contact being said portion of one of said first and second contacts extending from a respective one of said first and second surfaces.

9. The connector according to claim 8 wherein each of said second contacts comprises a shank secured within a portion of said second housing, a tail extending from said shank and arranged to be attached to a conductor, and a pair of beams extending from a side of said shank opposite said tail, said pair of beams having two opposed contact faces arranged to electrically engage opposite sides of a respective said blade-shaped contact when moved along said first mating axis into mated engagement therewith.

10. The connector according to claim 9 wherein each of said plurality of individual terminals comprises a shank, a tail extending from said shank arranged to be attached to a conductor, and a contact portion extending from said shank and arranged to electrically engage said blade-shaped contact when moved along said second mating axis into mated engagement therewith.

11. A first connector including a first housing having a plurality of first electrical contacts arranged in at least two rows, one of the at least two rows being offset laterally and vertically from the other of the at least two rows, and the first electrical contacts adapted for mating along a first mating axis of said first connector with respective ones of a plurality of mating second electrical contacts in a mating second housing of a mating second connector, each of said plurality of first electrical contacts being adapted for mating along a second mating axis, that is angled with respect to said first mating axis, with respective ones of a plurality of individual terminals, wherein each of said plurality of first electrical contacts comprises a shank secured within a portion of said first housing, a tail extending from said shank and arranged to be attached to a conductor by means of a coupling, and a pair of opposed contact surfaces extending from said shank opposite said tail, said pair of contact surfaces arranged to electrically engage opposite sides of a respective said second electrical contact when moved along said first mating axis into mated engagement therewith.

12. The connector according to claim 11 wherein said shank includes first and second opposite sides and third and fourth opposite sides interlocked to form a rigid box structure, each contact surface of said pair of opposed contact surfaces extending from a respective one of said first and second opposite sides.

13. The connector according to claim 11 wherein said shank includes a sacrificial member extending outwardly from said shank and arranged to electrically engage said respective second electrical contact prior to said electrical engagement of said pair of opposed contact surfaces with said respective second electrical contact.

14. The connector according to claim 12 including a guide member extending from said third side and wherein said tail extends from said fourth side.

15. The connector according to claim 14 wherein said coupling comprises a screw extending through a hole in said tail and a nut in threaded engagement with said screw, said nut being disposed in a depression formed in said first housing.

16. The connector according to claim 11 wherein said second housing includes first and second parallel rows of said second contacts, said first row of second contacts being offset from said second row of second contacts, each of said second contacts having a longitudinal axis substantially perpendicular to said first mating axis, wherein some of said plurality of first electrical contacts are arranged in an upper row and others of said plurality of first electrical contacts are arranged in a lower row that is offset from said upper row, each of said first electrical contacts in said upper row being adapted to mate with a respective one of said second electrical contacts in said first row of second electrical contacts and each of said first electrical contacts in said lower row being adapted to mate with a respective one of said second electrical contacts in said second row of second electrical contacts when said first connector and said second connector are moved along said first mating axis into mated engagement.

* * * * *